US011322116B2

(12) United States Patent
Lim et al.

(10) Patent No.: US 11,322,116 B2
(45) Date of Patent: May 3, 2022

(54) DISPLAY DEVICE AND METHOD FOR CONTROLLING BRIGHTNESS THEREOF

(71) Applicant: SAMSUNG ELECTRONICS CO., LTD., Suwon-si (KR)

(72) Inventors: Jaemoon Lim, Suwon-si (KR); Joseph Kim, Suwon-si (KR); Younghoon Jeong, Suwon-si (KR); Chun Zhao, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/264,183

(22) PCT Filed: Aug. 7, 2019

(86) PCT No.: PCT/KR2019/009887
§ 371 (c)(1),
(2) Date: Jan. 28, 2021

(87) PCT Pub. No.: WO2020/040457
PCT Pub. Date: Feb. 27, 2020

(65) Prior Publication Data

US 2021/0166604 A1 Jun. 3, 2021

(30) Foreign Application Priority Data

Aug. 23, 2018 (KR) ..... 10-2018-0098659

(51) Int. Cl.
*G09G 5/10* (2006.01)
*G09G 3/20* (2006.01)

(52) U.S. Cl.
CPC ..... *G09G 5/10* (2013.01); *G09G 3/2007* (2013.01); *G09G 2320/0271* (2013.01);
(Continued)

(58) Field of Classification Search
CPC ..... G09G 3/2003–2081; G09G 5/10; G09G 2320/0233; G09G 2320/0626–0653; G09G 2320/0673; G09G 2360/14–16
See application file for complete search history.

(56) References Cited

U.S. PATENT DOCUMENTS 4,947,253 A 8/1990 Neal
7,592,981 B2 9/2009 Maeda
(Continued)

FOREIGN PATENT DOCUMENTS

EP 3 435 365 A1 1/2019
JP 2006-113151 A 4/2006
(Continued)

OTHER PUBLICATIONS

Communication dated Jul. 30, 2021, issued by the European Patent Office in European Application No. 19852105.6.
(Continued)

*Primary Examiner* — Patrick F Marinelli
(74) *Attorney, Agent, or Firm* — Sughrue Mion, PLLC

(57) ABSTRACT

A display device is disclosed. The display device comprises: a storage configured to store output brightness information for each gradation according to brightness information of an image; and a processor configured to acquire target brightness corresponding to brightness information of an input image on the basis of the information stored in the storage, acquire a target light amount on the basis of a light amount of the input image, acquire a plurality of correction effects corresponding to a plurality of correction images by applying a plurality of gradation adjustment curves to the input image, acquire a gradation adjustment curve corresponding to the maximum correction effect among the plurality of
(Continued)

correction effects, and adjust and output a gradation for each pixel of the input image on the basis of the acquired gradation adjustment curve.

15 Claims, 11 Drawing Sheets

(52) U.S. Cl.
CPC ..... *G09G 2320/0626* (2013.01); *G09G 2320/0673* (2013.01); *G09G 2360/16* (2013.01)

(56) References Cited

U.S. PATENT DOCUMENTS

| | | | | |
|---|---|---|---|---|
| 8,228,351 | B2 | 7/2012 | Miura | |
| 8,958,658 | B1 | 2/2015 | Lim et al. | |
| 9,373,280 | B2 | 6/2016 | Yoon et al. | |
| 9,619,873 | B2 | 4/2017 | Tsuda et al. | |
| 10,692,466 | B2 * | 6/2020 | Lim | G09G 3/3208 |
| 10,699,674 | B2 * | 6/2020 | Jeong | G09G 3/2096 |
| 2006/0007511 | A1 * | 1/2006 | Koyama | H04N 21/4318 358/521 |
| 2007/0035557 | A1 | 2/2007 | Choe et al. | |
| 2011/0254878 | A1 | 10/2011 | Mori et al. | |
| 2014/0192101 | A1 | 7/2014 | Tsuge | |
| 2014/0285532 | A1 * | 9/2014 | Yang | H04N 9/3182 345/690 |
| 2015/0332444 | A1 | 11/2015 | Tsuda et al. | |
| 2018/0048875 | A1 | 2/2018 | Park et al. | |
| 2019/0027100 | A1 * | 1/2019 | Han | G09G 5/003 |
| 2019/0035357 | A1 * | 1/2019 | Lim | G09G 3/3208 |
| 2019/0206364 | A1 * | 7/2019 | Jeong | G09G 3/3208 |
| 2019/0265552 | A1 * | 8/2019 | Shiomi | G02F 1/133609 |
| 2020/0105226 | A1 * | 4/2020 | Greenebaum | G09G 5/10 |
| 2020/0380938 | A1 * | 12/2020 | Greenebaum | G09G 5/10 |
| 2021/0149694 | A1 * | 5/2021 | Guzman | G06F 8/38 |
| 2021/0166604 | A1 * | 6/2021 | Lim | G09G 3/20 |

FOREIGN PATENT DOCUMENTS

| | | | |
|---|---|---|---|
| JP | 4535198 | B2 | 9/2010 |
| KR | 10-2007-0019438 | A | 2/2007 |
| KR | 10-0832610 | B1 | 5/2008 |
| KR | 10-2009-0023275 | A | 3/2009 |
| KR | 10-2014-0082002 | A | 7/2014 |
| KR | 10-1609488 | B1 | 4/2016 |
| KR | 10-2016-0051821 | A | 5/2016 |
| KR | 10-2017-0107597 | A | 9/2017 |
| KR | 10-2018-0018067 | A | 2/2018 |
| KR | 10-2019-0012528 | A | 2/2019 |

OTHER PUBLICATIONS

International Search Report dated Nov. 15, 2019 issued by the International Searching Authority in International Application No. PCT/KR2019/009887 (PCT/ISA/210).

Written Opinion dated Nov. 15, 2019 issued by the International Searching Authority in International Application No. PCT/KR2019/009887 (PCT/ISA/237).

* cited by examiner

FIG. 8

| BRIGHTNESS / CURRENT | 0 nit | ... | 100 nit | ... | 900 nit | ... |
|---|---|---|---|---|---|---|
| R | 0 mA | | 40 mA | | 240 mA | |
| G | 0 mA | | 50 mA | | 300 mA | |
| B | 0 mA | | 30 mA | | 180 mA | |

(a)

CASE1 : LIGHT AMOUNT 187NIT (b)

CASE2 : LIGHT AMOUNT 187NIT (c)

CASE3 : LIGHT AMOUNT 187NIT

DISPLAY DEVICE AND METHOD FOR CONTROLLING BRIGHTNESS THEREOF

TECHNICAL FIELD

The disclosure relates to a display device and a method for controlling brightness thereof, and more particularly, to a display device that adjusts and outputs a gradation for each pixel of an input image, and a method for controlling brightness thereof.

DESCRIPTION OF THE RELATED ART

Spurred by the development of electronic technologies, electronic devices of various types are being developed and distributed. In particular, mobile devices and display devices like TVs that are being used the most recently have developed rapidly in a recent few years.

An LED display that enables outputs of a high light amount and high brightness has high availability in an outdoor environment like digital signage. However, in an indoor environment, an LED display has a problem of causing a glare phenomenon to a user due to a high light amount, and there are many cases wherein an LED display is used by reducing the light amount to a level of 25-50% of the maximum light amount.

Meanwhile, in conventional adjustment of a light amount, brightness of an image is just reduced linearly, or brightness of only a bright image is reduced and output, and thus there are problems that the dynamic range of an output image is reduced compared to the original image, the contrast ratio is reduced, and degradation or distortion occurs.

Also, there is a problem that an image is provided to a user while adjusting just the light amount without considering the characteristic of the image.

DETAILED DESCRIPTION OF THE INVENTION

Technical Problem

The disclosure is for addressing the aforementioned need, and the purpose of the disclosure is in providing a display device that minimizes a difference in a user's visual sense for an output image compared to an input image by adjusting the light amount of an image in consideration of the characteristic of the image, and a method for controlling brightness thereof.

Technical Solution

According to an embodiment of the disclosure for achieving the aforementioned purpose, a display device includes a storage configured to store output brightness information for each gradation according to brightness information of an image, and a processor configured to acquire target brightness corresponding to brightness information of an input image on the basis of the information stored in the storage, acquire a target light amount on the basis of a light amount of the input image, acquire a plurality of correction effects corresponding to a plurality of correction images by applying a plurality of gradation adjustment curves to the input image, acquire a gradation adjustment curve corresponding to the maximum correction effect among the plurality of correction effects, and adjust and output a gradation for each pixel of the input image on the basis of the acquired gradation adjustment curve, wherein the plurality of correction effects are acquired on the basis of a difference in a perceived visual sense between each of the plurality of correction images and the input image, a difference between the brightness of each of the plurality of correction images and the target brightness, and a difference between the light amount of each of the plurality of correction images and the target light amount.

Also, the target brightness may be the maximum output brightness corresponding to the brightness information of the input image, and the brightness of each of the plurality of correction images may be the maximum output brightness corresponding to the brightness information of each of the plurality of correction images.

In addition, the processor may acquire the light amount of the input image by summing up the brightness of each of the plurality of pixels included in the input image, and the target light amount may be a light amount which is a reduced amount of the light amount of the input image by a predetermined ratio.

Further, the processor may acquire a first correction image by applying a first gradation adjustment curve among the plurality of gradation adjustment curves to the input image, calculate a difference in a first perceived visual sense on the basis of a difference value between a graph indicating the gradation for each pixel included in the input image and the first gradation adjustment curve, calculate a first light amount difference between the light amount of the first correction image and the target light amount, calculate a first brightness difference between the maximum output brightness of the first correction image and the target brightness, and acquire a first correction effect on the basis of the following formula.

$$E=\alpha_{SIM}\omega_{SIM}+\alpha_{LUMA}\omega_{LUMA}+\alpha_{GRARE}\omega_{GRARE}$$

Here, $\alpha_{SIM}$ may be a first weighted value, $\alpha_{LUMA}$ may be a second weighted value, $\alpha_{GRARE}$ may be a third weighted value, $\omega_{SIM}$ may be the difference in the first perceived visual sense, $\omega_{LUMA}$ may be the first light amount difference, and $\omega_{GRARE}$ may be the first brightness difference, and each of the $\alpha_{SIM}$, the $\alpha_{LUMA}$, and the $\alpha_{GRARE}$ may be a weighted value that is neural network trained on the basis of a plurality of sample images.

Also, the processor may acquire a second correction image by applying a second gradation adjustment curve among the plurality of gradation adjustment curves to the input image, calculate a difference in a second perceived visual sense on the basis of the second gradation adjustment curve, and calculate a second light amount difference and a second brightness difference on the basis of the second correction image, acquire a second correction effect on the basis of the difference in the second perceived visual sense, the second light amount difference, and the second brightness difference, and adjust and output the gradation for each pixel of the input image on the basis of a gradation adjustment curve corresponding to the smaller value between the first correction effect and the second correction effect.

Meanwhile, the plurality of gradation adjustment curves may be a graph indicated by the following formula, and have different αs and βs.

$$t_i = \alpha \times \frac{i}{255}^{(2.2+\beta)}$$

Here, i means the gradation for each pixel included in an input image, α and β respectively mean first and second adjustment values, and $t_i$ means the gradation of a correction image.

Meanwhile, the display device may further include a display, and the storage may store information for a current gain for each maximum brightness of an image, and the processor may, based on the gradation for each pixel of the input image being adjusted on the basis of the acquired gradation adjustment curve, acquire current gain information corresponding to the maximum output brightness of the adjusted input image from the storage, and control currents provided to the display on the basis of the current gain information.

Also, brightness information of the image may be an average picture level (APL) of the image, and output brightness information for each gradation according to the brightness information of the image may be the maximum output brightness information for each gradation according to the average picture level calculated on the basis of the power consumption of the display device.

In addition, the processor may, based on the gradation for each pixel of the input image being adjusted on the basis of the acquired gradation adjustment curve, identify the adjusted input image as a plurality of blocks, and acquire a local gradation adjustment curve corresponding to each of the plurality of blocks on the basis of gradation distribution and gradation average values of each of the plurality of blocks, and adjust the gradation for each pixel of each of the plurality of blocks on the basis of the acquired local gradation adjustment curve.

Further, the processor may apply the first weighted value to each gradation value of pixels included in a first block of an image to which the gradation adjustment curve was applied, apply the second weighted value to each gradation value of pixels included in a block corresponding to the first block in an image to which the local gradation adjustment curve was applied, and adjust and output the gradation for each pixel on the basis of the gradation value to which the first weighted value was applied and the gradation value to which the second weighted value was applied.

According to an embodiment of the disclosure, a method for controlling brightness of a display device storing output brightness information for each gradation according to brightness information of an image includes the steps of acquiring target brightness corresponding to brightness information of an input image on the basis of the stored information, acquiring a target light amount on the basis of a light amount of the input image, acquiring a plurality of correction effects corresponding to a plurality of correction images by applying a plurality of gradation adjustment curves to the input image, acquiring a gradation adjustment curve corresponding to the maximum correction effect among the plurality of correction effects, and adjusting and outputting a gradation for each pixel of the input image on the basis of the acquired gradation adjustment curve, wherein the plurality of correction effects are acquired on the basis of a difference in a perceived visual sense between each of the plurality of correction images and the input image, a difference between the brightness of each of the plurality of correction images and the target brightness, and a difference between the light amount of each of the plurality of correction images and the target light amount.

Also, the target brightness may be the maximum output brightness corresponding to the brightness information of the input image, and the brightness of each of the plurality of correction images may be the maximum output brightness corresponding to the brightness information of each of the plurality of correction images.

In addition, in the step of acquiring a target light amount, the light amount of the input image may be acquired by summing up the brightness of each of the plurality of pixels included in the input image, and the target light amount may be a light amount which is a reduced amount of the light amount of the input image by a predetermined ratio.

Further, the step of acquiring a plurality of correction effects may include the steps of acquiring a first correction image by applying a first gradation adjustment curve among the plurality of gradation adjustment curves to the input image, calculating a difference in a first perceived visual sense on the basis of a difference value between a graph indicating the gradation for each pixel included in the input image and the first gradation adjustment curve, calculating a first light amount difference between the light amount of the first correction image and the target light amount, calculating a first brightness difference between the maximum output brightness of the first correction image and the target brightness, and acquiring a first correction effect on the basis of the following formula.

$$E=\alpha_{SIM}\omega_{SIM}+\alpha_{LUMA}\omega_{LUMA}+\alpha_{GRARE}\omega_{GRARE}$$

Here, $\alpha_{SIM}$ may be a first weighted value, $\alpha_{LUMA}$ may be a second weighted value, $\alpha_{GRARE}$ may be a third weighted value, $\omega_{SIM}$ may be the difference in the first perceived visual sense, $\omega_{LUMA}$ may be the first light amount difference, and $\omega_{GRARE}$ may be the first brightness difference, and each of the $\alpha_{SIM}$, the $\alpha_{LUMA}$, and the $\alpha_{GRARE}$ may be a weighted value that is neural network trained on the basis of a plurality of sample images.

Also, the step of acquiring a plurality of correction effects may include the steps of acquiring a second correction image by applying a second gradation adjustment curve among the plurality of gradation adjustment curves to the input image, calculating a difference in a second perceived visual sense on the basis of the second gradation adjustment curve, and calculating a second light amount difference and a second brightness difference on the basis of the second correction image, and acquiring a second correction effect on the basis of the difference in the second perceived visual sense, the second light amount difference, and the second brightness difference. In addition, in the step of adjusting and outputting the gradation for each pixel of the input image, the gradation for each pixel of the input image may be adjusted and output on the basis of a gradation adjustment curve corresponding to the smaller value between the first correction effect and the second correction effect.

Meanwhile, the plurality of gradation adjustment curves may be a graph indicated by the following formula, and have different αs and βs.

$$t_i = \alpha \times \frac{i}{255}^{(2.2+\beta)}$$

Here, i means the gradation for each pixel included in an input image, α and β respectively mean first and second adjustment values, and $t_i$ means the gradation of a correction image.

Meanwhile, the display device may include information for a current gain for each maximum brightness of an image, and the controlling method may include the steps of, based on the gradation for each pixel of the input image being adjusted on the basis of the acquired gradation adjustment curve, acquiring current gain information corresponding to the maximum output brightness of the adjusted input image from the information, and controlling currents provided to the display included in the display device on the basis of the current gain information.

Also, brightness information of the image may be an average picture level (APL) of the image, and output brightness information for each gradation according to the brightness information of the image may be the maximum output brightness information for each gradation according to the average picture level calculated on the basis of the power consumption of the display device.

In addition, the controlling method may include the steps of, based on the gradation for each pixel of the input image being adjusted on the basis of the acquired gradation adjustment curve, identifying the adjusted input image as a plurality of blocks, and acquiring a local gradation adjustment curve corresponding to each of the plurality of blocks on the basis of gradation distribution and gradation average values of each of the plurality of blocks, and adjusting the gradation for each pixel of each of the plurality of blocks on the basis of the acquired local gradation adjustment curve.

Further, the controlling method may include the steps of, applying the first weighted value to each gradation value of pixels included in a first block of an image to which the gradation adjustment curve was applied, applying the second weighted value to each gradation value of pixels included in a block corresponding to the first block in an image to which the local gradation adjustment curve was applied, and adjusting and outputting the gradation for each pixel on the basis of the gradation value to which the first weighted value was applied and the gradation value to which the second weighted value was applied.

Effect of the Invention

According to the various embodiments of the disclosure, a light amount can be adjusted in consideration of the characteristic of an input image. Accordingly, an image can be provided to a user while increasing the dynamic range and minimizing distortion and degradation of the image, at the same time as preventing a glare phenomenon.

BRIEF DESCRIPTION OF DRAWINGS

FIG. 8 is a table for illustrating current gains according to an embodiment of the disclosure;

BEST MODE FOR IMPLEMENTING THE INVENTION

Mode for Implementing the Invention

Figure 1:
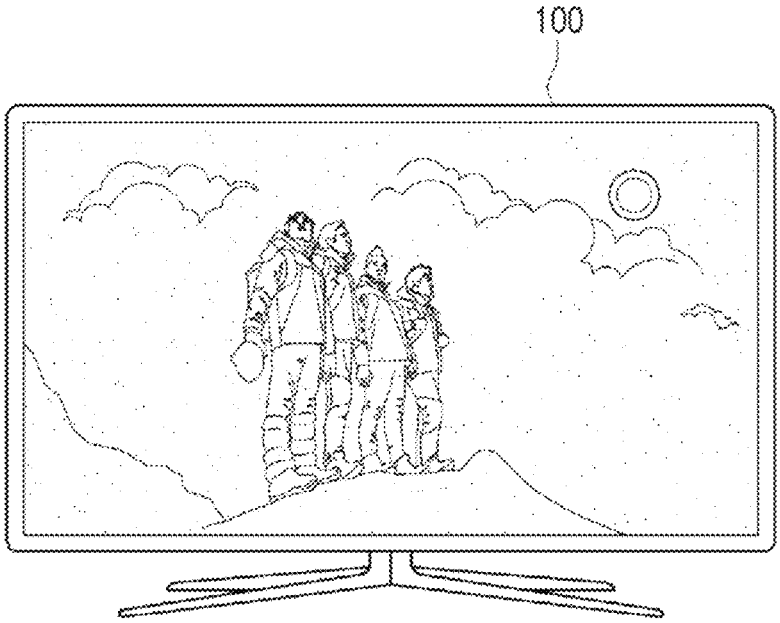
FIG. 1 is a diagram for illustrating a display device adjusting a light amount according to an embodiment of the disclosure.

First, terms used in this specification will be described briefly, and then the disclosure will be described in detail.

As terms used in the embodiments of the disclosure, general terms that are currently used widely were selected as far as possible, in consideration of the functions described in the disclosure. However, the terms may vary depending on the intention of those skilled in the art who work in the pertinent field, previous court decisions, or emergence of new technologies. Also, in particular cases, there may be terms that were designated by the applicant on his own, and in such cases, the meaning of the terms will be described in detail in the relevant descriptions in the disclosure. Thus, the terms used in the disclosure should be defined based on the meaning of the terms and the overall content of the disclosure, but not just based on the names of the terms.

Also, various modifications may be made to the embodiments of the disclosure, and there may be various types of embodiments. Accordingly, specific embodiments will be illustrated in drawings, and the embodiments will be described in detail in the detailed description. However, it should be noted that the various embodiments are not for limiting the scope of the disclosure to a specific embodiment, but they should be interpreted to include all modifications, equivalents, or alternatives of the embodiments included in the ideas and the technical scopes disclosed herein. Meanwhile, in case it is determined that in describing embodiments, detailed explanation of related known technologies may unnecessarily confuse the gist of the disclosure, the detailed explanation will be omitted.

In addition, terms such as "first," "second" and the like may be used to describe various elements, but the terms are not intended to limit the elements. Such terms are used only to distinguish one element from another element.

Further, singular expressions may include plural expressions, unless defined obviously differently in the context. In addition, in the disclosure, terms such as "include" and "consist of" should be construed as designating that there are such characteristics, numbers, steps, operations, elements, components, or a combination thereof described in the specification, but not as excluding in advance the existence or possibility of adding one or more of other characteristics, numbers, steps, operations, elements, components, or a combination thereof.

Also, in the disclosure, "a module" or "a part" performs at least one function or operation, and it may be implemented as hardware or software, or as a combination of hardware and software. Further, a plurality of "modules" or "parts" may be integrated into at least one module and implemented as at least one processor (not shown), except "modules" or "parts" that need to be implemented as specific hardware.

Hereinafter, the embodiments of the disclosure will be described in detail with reference to the accompanying drawings, such that those having ordinary skill in the art to which the disclosure belongs can easily carry out the disclosure. However, it should be noted that the disclosure may be implemented in various different forms, and is not limited to the embodiments described herein. Also, in the drawings, parts that are not related to explanation were omitted, for explaining the disclosure clearly, and throughout the specification, similar components were designated by similar reference numerals.

FIG. 1 is a diagram for illustrating a display device adjusting a light amount according to an embodiment of the disclosure.

As illustrated in FIG. 1, the display device 100 may be implemented as a TV, but is not limited thereto, and it may be implemented as electronic devices in various types that perform image processing. For example, an electronic device may be implemented as source devices in various types that provide a content to a display device such as a blue ray player, a digital versatile disc (DVD) player, a streaming content output device, a set top box, etc. The display device 100 may perform image processing according to various embodiments of the disclosure for an image and output the image by itself, or provide the image to another electronic device including a display.

Also, the display device 100 can obviously be implemented as a device equipped with a display function such as a TV, a smartphone, a tablet PC, a PMP, a PDA, a laptop PC, a smart watch, a head mounted display (HMD), a near eye display (NED), etc. The display device 100 may be implemented to include displays in various forms such as a liquid crystal display (LCD), organic light-emitting diodes (OLED), Liquid Crystal on Silicon (LCoS), Digital Light Processing (DLP), micro LEDs, a quantum dot (QD) display panel, etc. for providing a display function.

In particular, the display device 100 may include a display consisting of self-emitting diodes such as organic light-emitting diodes (OLED), and in this case, problems that a user's glare phenomenon occurs in an indoor environment due to the high light amount of the display, and the lifespan of self-emitting diodes is shortened due to high power consumption are generated.

Accordingly, if a bright image is input, the display device 100 according to an embodiment of the disclosure may adjust the light amount of the image, and thereby make it possible to prevent a glare phenomenon.

However, if the light amount of an input image is reduced to a specific level for preventing a glare phenomenon, the dynamic range indicating how many signals can be expressed when expressing the image is also reduced.

As an example, if the maximum output brightness of an image is linearly reduced for reducing the light amount, the dynamic range becomes greatly narrower, and a difference in a perceived visual sense of a user for a corrected image compared to an input image becomes substantially bigger.

Accordingly, the display device 100 according to an embodiment of the disclosure may, in adjusting the light amount of an input image, make it possible that the power consumption of the display device 100 and the dynamic range of the input image are maintained at a specific level.

Specifically, the display device 100 may reduce the light amount of an input image by greater than or equal to a specific ratio, and at the same time, minimize a difference in a perceived visual sense for an image of which light amount was corrected compared to an input image, i.e., distortion of an input image, and secure a dynamic range of a specific level and output the input image. Hereinafter, various embodiments of the disclosure will be described with reference to the drawings.

Figure 2:
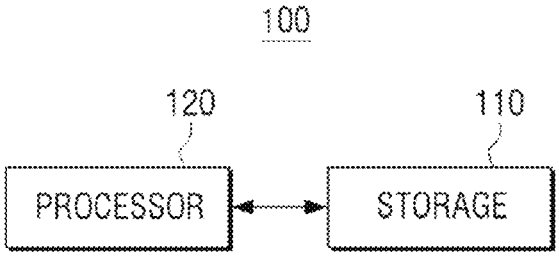
FIG. 2 is a block diagram illustrating a configuration of a display device according to an embodiment of the disclosure.

FIG. 2 is a block diagram illustrating a configuration of a display device according to an embodiment of the disclosure.

According to FIG. 2, the display device 100 includes a storage 110 and a processor 120.

The storage 110 stores an operating system (O/S) software module for driving the display device 100, and various data such as various kinds of multimedia contents.

In particular, in the storage 110, output brightness information for each gradation according to brightness information of an image may be stored. Here, a gradation expresses the brightness of each pixel included in an image as an integer. As an example, an image of 8 bit may be expressed as a gradation of from level 0 to 255. Meanwhile, an integer corresponding to the brightness of each pixel may be expressed as a gradation value, a brightness value, a brightness code, etc., but hereinafter, it will be generally referred to as a gradation value for the convenience of explanation.

Also, brightness information of an image may be an average picture level (hereinafter, referred to as "APL") for each frame of the image. As an example, it may be an average gradation value for pixel data in a unit of 1 frame of an input image. As an APL is higher, an image may be a relatively bright image, and as an APL is lower, an image may be a relatively dark image. Meanwhile, brightness of an image may mean various characteristics of pixels included in an image of the display device 100 such as the maximum gradation value, the mode gradation value, etc. other than an APL.

Output brightness information for each gradation according to an embodiment of the disclosure may be output brightness information for each gradation of an input image in consideration of the power consumption of the display device 100. As an example, the maximum output brightness may be restricted according to the brightness of an input image, such that the display device 100 outputs the input image within the maximum power consumption (or, the average power consumption). For example, a gradation value of level 255 may be output as brightness of from 160 to 1000 Nits according to the brightness of the input image. As another example, a gradation value of level 254 may be output as brightness of from 140 Nits to 900 Nits according to the brightness of the image. Output brightness for each gradation (for each brightness code) may be adjusted to be relatively lower compared to the output brightness for each gradation of a relatively darker image, such that the display device 100 outputs a bright image within the maximum power consumption (or, the average power consumption). Detailed explanation in this regard will be made with reference to FIG. 4.

The processor 120 controls the overall operations of the display device 100. The processor 120 may include one or more of a digital signal processor (DSP), a central processing unit (CPU), a controller, an application processor (AP), or a communication processor (CP), and an ARM processor, or may be defined by the terms.

In particular, the processor 120 may acquire brightness information of an input image. Here, brightness information of an input image may be, as described above, an average picture level (APL) of each frame of the input image. That is, the processor 120 may acquire an average gradation value for a plurality of pixels included in an image. However, the disclosure is not limited thereto, and brightness information of an input image may be any information if it is a characteristic of an image influencing the power consumption of the display device 100 when outputting the image. As an example, the processor 120 may acquire brightness information of an input image according to various standards such as the maximum gradation value among a plurality of gradation values of the input image, the maximum gradation value for each of R, G, and B, the mode gradation value, the mode gradation value for each of R, G, and B, the maximum brightness information of the image, etc.

The processor 120 according to an embodiment of the disclosure may acquire target brightness corresponding to brightness information of an input image. Here, the target brightness may be the maximum output brightness corresponding to brightness information of an input image. As an example, the processor 120 may acquire the maximum output brightness as the target brightness on the basis of information on output brightness for each gradation corresponding to the average picture level (APL) of an input image. For example, in output brightness for each gradation of level 0 to 255 corresponding to the average picture level of an input image, the processor 120 may acquire the output brightness of a gradation of level 255 as the target brightness.

The processor 120 according to an embodiment of the disclosure may acquire a target light amount on the basis of the light amount of an input image. Here, the light amount of an input image may be the sum of brightness of each pixel in the input image. A light amount is the amount of entire lights emitted through the display according to output of an input image, and as a light amount is higher, a glare phenomenon occurs more frequently.

The processor 120 according to an embodiment may acquire a light amount of an input image and a target light amount based on the following formula 1:

$$G = 0.5 \times \sum_{p \in I} L\left(\frac{c_p}{255}\right)^{2.2} \quad \text{[Formula 1]}$$

Here, the processor 120 may acquire a light amount by using the gradation value (or, the brightness code) $c_p$ for each pixel p in an image I. Also, in the formula 1, 0.5 may be an example of a predetermined ratio. For example, the processor 120 may acquire a light amount which is an amount reduced as much as a ratio of 0.5 from the light amount of the input image as the target light amount G. As another example, the processor 120 can obviously acquire a target light amount based on various ratios such as 0.7 and 0.3. A predetermined ratio may be changed variously according to the purpose of the manufacturer, the setting of a user, the characteristic of an input image, etc.

If the processor 120 adjusts and outputs the output brightness for each gradation such that the light amount of an input image gets close to the target light amount, a glare phenomenon may be prevented, but distortion of the output image compared to the input image may occur. For example, a difference in a perceived visual sense may occur, and the width of the dynamic range of the output image may become narrower. That is, the output image may be provided to a user while a difference between a dark part and a bright part in the output image becomes degraded compared to a difference between a dark part and a bright part in the input image. The processor 120 according to an embodiment of the disclosure may adjust the gradation of an input image in consideration of a difference in a perceived visual sense, target brightness, etc. other than a target light amount.

The processor 120 according to an embodiment of the disclosure may acquire a plurality of correction effects corresponding to a plurality of correction images according to applying a plurality of gradation adjustment curves to an input image. Here, a gradation adjustment curve may be a curve that adjusts a gradation for each pixel included in an input image to another gradation. As an example, for a gradation adjustment curve, a tone mapping (TM) curve may be used. However, the disclosure is not limited thereto, and various types of formulae and graphs that can adjust a gradation of a pixel in an image to another gradation may be used as gradation adjustment curves. A gradation adjustment curve according to an embodiment of the disclosure will be described in detail with reference to FIG. 5.

The processor 120 may acquire a gradation adjustment curve corresponding to the maximum correction effect among a plurality of correction effects. As an example, the processor 120 may acquire a plurality of correction effects on the basis of a difference in a perceived visual sense between each of a plurality of correction images and an input image, a difference between the brightness of each of a plurality of correction images and the target brightness, and a difference between the light amount of each of a plurality of correction images and the target light amount.

The processor 120 according to an embodiment of the disclosure may acquire a first correction image by applying a first gradation adjustment curve among a plurality of gradation adjustment curves to an input image. Here, the first correction image may be an image wherein a gradation value for each pixel included in an input image was adjusted according to the first gradation adjustment curve. The processor 120 may calculate a difference in a first perceived visual sense on the basis of a difference value between a graph indicating a gradation for each pixel included in the input image and the first gradation adjustment curve. Here, the difference in the perceived visual sense may be all characteristics that were degraded compared to the input image as a gradation for each pixel of the input image was adjusted based on the gradation adjustment curve. As an example, the processor 120 may acquire a difference in a perceived visual sense on the basis of amounts of changes of brightness of a correction image compared to an input image, a contrast ratio, a gamma value, a gradation value, etc. A graph indicating a gradation for each pixel included in an input image may be a graph indicating the original image wherein a gradation for each pixel of the input image was not adjusted. As an example, a graph indicating a gradation for each pixel included in an input image may be a graph corresponding to a gradation adjustment curve that maintains the gradation for each pixel included in the input image among a plurality of gradation adjustment curves.

The processor 120 according to an embodiment of the disclosure may calculate a first light amount difference between the light amount of the first correction image and the target light amount. Also, the processor 120 may calculate a first brightness difference between the maximum output brightness of the first correction image and the target brightness.

The processor 120 according to an embodiment of the disclosure may acquire a correction effect E based on the following formula 2.

$$E = \alpha_{SIM}\omega_{SIM} + \alpha_{LUMA}\omega_{LUMA} + \alpha_{GRARE}\omega_{GRARE} \quad \text{[Formula 2]}$$

Here, $\alpha_{SIM}$ is a first weighted value, $\alpha_{LUMA}$ is a second weighted value, $\alpha_{GRARE}$ is a third weighted value, $\omega_{SIM}$ is the difference in the first perceived visual sense, $\omega_{LUMA}$ is the first light amount difference, and $\omega_{GRARE}$ is the first brightness difference.

Also, each of the first weighted value $\alpha_{SIM}$, the second weighted value $\alpha_{LUMA}$, and the third weighted value $\alpha_{GRARE}$ may be weighted values that are neural network trained on the basis of a plurality of sample images.

According to an embodiment of the disclosure, the processor 120 may acquire an image processing model by performing machine learning to a plurality of sample images having different characteristics from one another, and acquire weighted values. For example, the processor 120 may acquire the first to third weighted values on the basis of a model acquired by performing convolution neural network (CNN) training to a plurality of sample images. Here, a CNN is a multilayer neural network having a special connection structure designed for voice processing, image processing, etc. The processor 120 may acquire the first to third weighted values corresponding to the characteristic of an input image according to the learning result. However, the disclosure is not limited thereto, and the processor 120 can obviously acquire a model based on various learning technics such as a recurrent neural network (RNN), a multilayer perceptron (MLP), etc., and acquire a plurality of weighted values. Detailed explanation regarding the first to third weighted values will be made with reference to FIG. 6.

According to an embodiment of the disclosure, the processor 120 may acquire a second correction image by applying a second gradation adjustment curve among a plurality of gradation adjustment curves to an input image. Then, the processor 120 may calculate a difference in a second perceived visual sense on the basis of the second gradation adjustment curve, and calculate a second light amount difference and a second brightness difference on the basis of the second correction image. Also, according to an embodiment, the processor 120 may acquire a second correction effect on the basis of the formula 2.

According to an embodiment, the processor 120 may acquire the first to nth correction effects. Also, the processor 120 may identify the maximum correction effect among a plurality of correction effects, and acquire a gradation adjustment curve corresponding to the identified maximum correction effect. For example, the processor 120 may identify the correction effect having the smaller value between the first and second correction effects acquired on the basis of the formula 2 as the maximum correction effect. Then, the processor 120 may adjust and output a gradation for each pixel of an input image on the basis of the gradation adjustment curve corresponding to the identified maximum correction effect.

Figure 3:
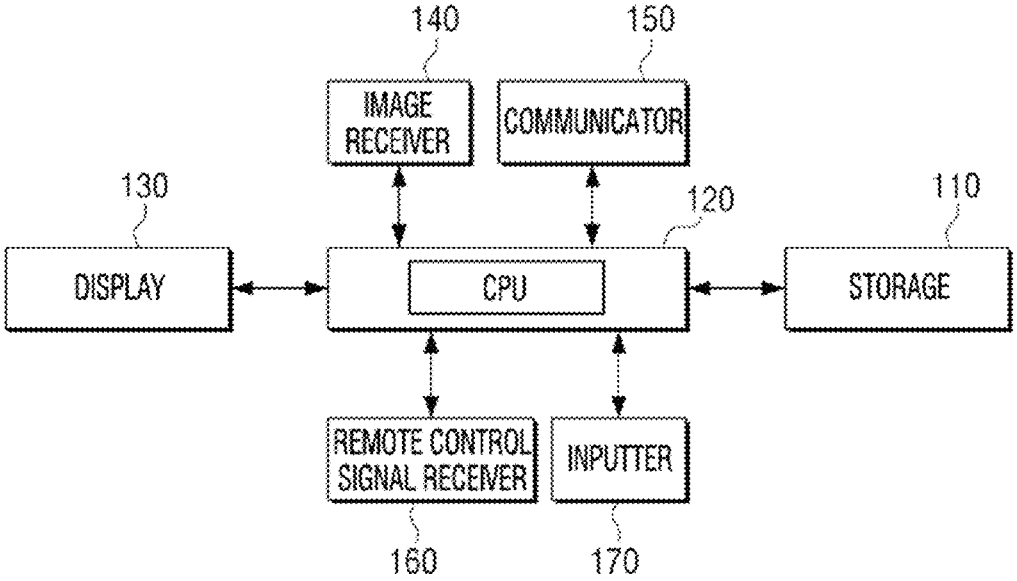
FIG. 3 is a block diagram illustrating a detailed configuration of the display device illustrated in FIG. 2.

FIG. 3 is a block diagram illustrating a detailed configuration of the display device illustrated in FIG. 2.

According to FIG. 3, the display device 100 includes a storage 110, a processor 120, a display 130, a content receiver 140, a communicator 150, a remote control signal receiver 160, and an inputter 170. Among the components illustrated in FIG. 3, regarding the components overlapping with the components illustrated in FIG. 2, detailed explanation will be omitted.

The processor 120 may acquire target brightness corresponding to brightness information of an input image on the basis of information stored in the storage 110, and acquire a target light amount on the basis of the light amount of the input image. Then, the processor 120 may acquire a plurality of correction effects corresponding to a plurality of correction images according to applying a plurality of gradation adjustment curves to the input image.

Also, the processor 120 may acquire a gradation adjustment curve corresponding to the maximum correction effect among the plurality of correction effects, and adjust and output the gradation for each pixel of the input image on the basis of the acquired gradation adjustment curve. Here, the display device 100 may include a display 130 in itself and output a correction image. Also, the processor 120 can obviously provide a correction image to an external electronic device including a display.

Meanwhile, the plurality of correction effects may be acquired on the basis of a difference in a perceived visual sense between each of the plurality of correction images and an input image, a difference between the brightness of each of the plurality of correction images and the target brightness, and a difference between the light amount of each of the plurality of correction images and the target light amount. According to an embodiment of the disclosure, a difference in a perceived visual sense and brightness are considered together in addition to a light amount, and thus degradation and distortion of a dynamic range compared to an input image can be minimized while a glare phenomenon is prevented.

The processor 120 according to an embodiment of the disclosure may include a CPU, a ROM (or a non-volatile memory) storing a control program for controlling the display device 100, and a RAM (or a volatile memory) that stores data input from the outside of the display device 100 or is used as a storage area corresponding to various jobs performed in the display device 100.

The CPU accesses the storage 110, and performs booting by using an O/S stored in the storage 110. Then, the CPU performs various operations by using various kinds of programs, contents, data, etc. stored in the storage 110.

Here, the storage 110 may be implemented as an internal memory such as a ROM, a RAM, etc. included in the processor 120, or a memory separate from the processor 120. In this case, the storage 110 may be implemented in the form of a memory embedded in the display device 100, or in the form of a memory that can be attached to or detached from the display device 100, according to the usage of stored data. For example, in the case of data for operating the display device 100, the data may be stored in a memory embedded in the display device 100, and in the case of data for the extended function of the display device 100, the data may be stored in a memory that can be attached to or detached from the display device 100. Meanwhile, in the case of a memory embedded in the display device 100, the memory may be implemented in forms such as a non-volatile memory, a volatile memory, a hard disc drive (HDD), or a solid state drive (SSD), etc., and in the case of a memory that can be attached to or detached from the display device 100, the memory may be implemented in forms such as a memory card (e.g., a micro SD card, a USB memory, etc.), and an external memory that can be connected to a USB port (e.g., a USB memory), etc.

The display 130 may provide various content screens that can be provided through the display device 100. Here, a content screen may include various contents such as images, moving images, texts, music, etc., application execution screens including various contents, a graphic user interface (GUI) screen, etc.

Meanwhile, the display 130 may be implemented as displays in various forms such as a liquid crystal display, organic light-emitting diodes, Liquid Crystal on Silicon (LCoS), Digital Light Processing (DLP), etc., as described above. Also, it is possible that the display 130 is implemented with a transparent material and is implemented as a transparent display displaying information.

In particular, according to an embodiment of the disclosure, the display 130 may be implemented as a self-emitting display such as organic light-emitting diodes (OLED).

Meanwhile, the display 130 may be implemented in the form of a touch screen that constitutes an interlayer structure with a touch pad, and in this case, the display 130 may be used as a user interface other than an output device.

The image receiver 140 may be implemented as a tuner receiving broadcast images, but the disclosure is not limited thereto, and the image receiver 140 may be implemented as communication modules in various forms that can receive various external images such as a Wi-Fi module, a USB module, an HDMI module, etc. Also, an image may be stored in the storage 110, and in this case, the display device 100 can obviously adjust and output a gradation for each pixel of the image stored in the storage 110, the output brightness, and the light amount according to various embodiments of the disclosure.

The communicator 150 may transmit/receive images. For example, the communicator 150 may receive input of audio signals by a streaming or download method from an external device (e.g., a source device), an external storage medium (e.g., a USB), an external server (e.g., a webhard), etc. through communication methods such as Wi-Fi based on AP (Wi-Fi, a wireless LAN network), Bluetooth, Zigbee, a wired/wireless local area network (LAN), a WAN, an Ethernet, IEEE 1394, an HDMI, a USB, an MHL, an AES/EBU, optical, coaxial, etc.

Also, the communicator 150 may receive output brightness information for each gradation according to brightness information of an image from an external server (not shown). As an example, the display device 100 may receive information from an external server and store the information in the storage 110, and the display device 100 can obviously update prestored information on the basis of the information received from the external server. Also, the display device 100 may acquire a weighted value used for acquiring a correction effect from a server.

The remote control signal receiver 160 is a component for receiving a remote control signal transmitted from a remote control. The remote control signal receiver 160 may be implemented in a form of including a light receiving part for receiving input of an infrared (IR) signal, or it may be implemented in a form of performing communication with a remote control according to a wireless communication protocol such as Bluetooth and Wi-Fi and receiving a remote control signal.

The inputter 170 may be implemented as various kinds of buttons provided on the main body of the display device 100. A user may input various user instructions such as a turn-on/turn-off instruction, a channel converting instruction, a volume adjusting instruction, a menu checking instruction, etc. through the inputter 170.

Meanwhile, the display device 100 according to an embodiment of the disclosure may perform adjustment of gradations, output brightness, and a light amount, etc. of an input image according to various embodiments of the disclosure in response to user instructions for the remote control signal receiver 160 and the inputter 170. As an example, the display device 100 may have a plurality of modes. For example, the display device 100 may include a maximum output mode (or, an outdoor mode) increasing the power consumption of the display device 100 when outputting an image, a standard mode, a power saving mode (or, an indoor mode) for reducing the power consumption of the display device 100 when outputting an image, etc. The display device 100 may identify the maximum correction effect among a plurality of correction effects on the basis of the currently set mode, and acquire a gradation adjustment curve corresponding to the maximum correction effect.

As an example, if the display device 100 is in an outdoor mode, it may be determined that the display device 100 is used in an environment wherein a user is relatively less sensitive to a glare phenomenon, and an input image may be output while the light amount of the input image is not reduced or is increased. As another example, if the display device 100 is in an indoor mode, it may be determined that the display device 100 is used in an environment wherein a user is relatively sensitive to a glare phenomenon, and an input image may be output while the light amount of the input image is reduced. Also, it is obvious that the light amount of an input image can be reduced on the basis of a predetermined ratio corresponding to a user input.

Figure 4:
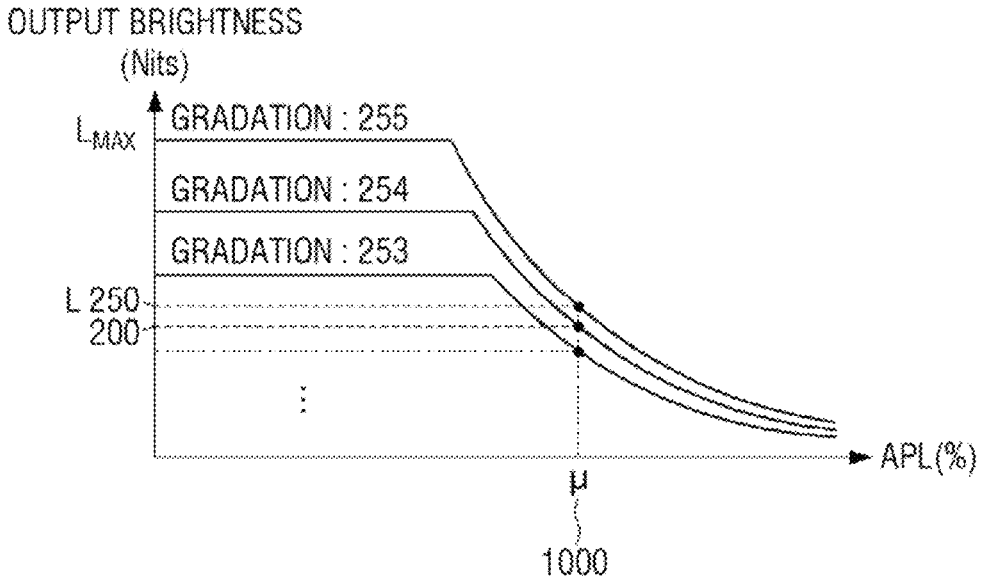
FIG. 4 is a graph for illustrating output brightness information for each gradation according to an embodiment of the disclosure.

FIG. 4 is a graph for illustrating output brightness information for each gradation according to an embodiment of the disclosure.

Referring to FIG. 4, in the display device 100, information on output brightness for each gradation according to brightness information of an image may be stored. Specifically, in the graph illustrated in FIG. 4, the X axis indicates a brightness average (e.g., an APL) of an image, and the Y axis indicates output brightness (Nits). Each graph indicates output brightness for each gradation while the maximum power consumption (or, the average power consumption) of the display device 100 is maintained. For example, in the case of an image of 8 bit, a gradation is expressed as an integer of from 0 to 255, and thus 256 graphs in total indicating output brightness (the Y axis) according to the brightness average (the X axis) of the image for each gradation of each of 0 to 255 may be stored. Hereinafter, the graph illustrated in FIG. 4 will be generally referred to as a peak luminance control (PLC) curve.

Meanwhile, the X axis of the PLC curve is not limited to an APL, and it is obvious that a value according to various characteristics of an image that can digitize the brightness of the image or various characteristics of an image influencing the power consumption of the display device 100 when outputting the image can be set as the X axis. As an example, in the display device 100, a graph wherein the average of the maximum brightness for each of R, G, and B of an image is set as an X axis may be stored.

The display device 100 according to an embodiment of the disclosure may acquire target brightness L corresponding to brightness information of an input image μ (1000). As an example, if brightness information of an input image μ (1000) is 90%, the display device 100 may output a gradation value (or, a brightness code) of 255 among the gradations included in the input image as brightness of 250 Nits, and output a gradation value of 254 as brightness of 200 Nits. According to an embodiment, the display device 100 may acquire the maximum brightness $L_{MAX}$ that can be output in brightness information of an input image μ (1000) as target brightness. For example, if brightness information of an input image μ (1000) is 90%, the display device 100 may acquire brightness of 250 Nits corresponding to the gradation value of 255 as the target brightness L.

Also, the display device 100 according to an embodiment of the disclosure may acquire the maximum output brightness of each of a plurality of correction images according to applying a plurality of gradation adjustment curves to an input image. For example, the display device 100 may acquire a first correction image by applying a first gradation adjustment curve to an input image, and acquire the maximum output brightness corresponding to the brightness information of the first correction image. Then, the display device 100 may acquire a first brightness difference between the maximum output brightness of the first correction image and the target brightness. Here, the first brightness difference means $\omega_{GRARE}$ in the formula 2.

According to an embodiment of the disclosure, the display device 100 may acquire a second correction image by applying a second gradation adjustment curve to an input image, and acquire the maximum output brightness corresponding to the brightness information of the second correction image. Then, the display device 100 may acquire a second brightness difference between the maximum output brightness of the second correction image and the target brightness.

Figure 5:
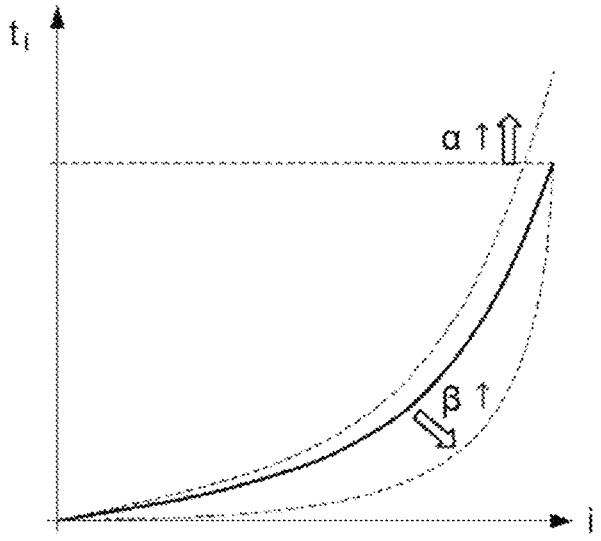
FIG. 5 is a graph for illustrating a gradation adjustment curve according to an embodiment of the disclosure.

FIG. 5 is a graph for illustrating a gradation adjustment curve according to an embodiment of the disclosure.

Referring to FIG. 5, the display device 100 may adjust gradations for each pixel included in an input image to gradations different from one another on the basis of a gradation adjustment curve. As an example, a gradation adjustment curve may be a tone mapping curve on the basis of the following formula 3, and may have a trajectory as illustrated in FIG. 5. In the graph, the X axis indicates a gradation of an input image, and the Y axis indicates a gradation of a correction image. However, a gradation adjustment curve is not limited to the following formula 3, and it may be formulae, trajectories, and graphs in various types that map a gradation to another adjustment gradation.

$$t_i = \alpha \times \frac{i}{255}^{(2.2+\beta)}$$

Here, i means the gradation for each pixel included in an input image, $\alpha$ and $\beta$ respectively mean first and second adjustment values, and $t_i$ means the gradation of a correction image.

Referring to FIG. 5, as $\alpha$ becomes bigger, the gradation of a correction image $t_i$ corresponding to the gradation of the input image i may become bigger, and as $\beta$ becomes bigger, the gradation of a correction image $t_i$ corresponding to the gradation of the input image i may become smaller. As an example, a case wherein $\alpha$ is 255, and $\beta$ is 2 may be assumed. In this case, the gradation value of a pixel corresponding to a gradation value of 200 among the plurality of pixels included in the input image may be adjusted to 91.9. Also, the gradation value of a pixel corresponding to a gradation value of 240 among the plurality of pixels included in the input image may be adjusted to 197.7. When the gradation values of all pixels (e.g., 0 to 255) included in the input image are adjusted on the basis of the formula 3 as described above, the brightness information of the input image may be adjusted, and the display device 100 may acquire a first correction image.

According to another embodiment, a case wherein $\alpha$ is 300, and $\beta$ is 1 may be assumed. In this case, the gradation value of a pixel corresponding to a gradation value of 200 among the plurality of pixels included in the input image may be adjusted to 137.9. When the gradation values of all pixels (e.g., 0 to 255) included in the input image are adjusted on the basis of the formula 3 as described above, the brightness information of the input image may be adjusted, and the display device 100 may acquire a second correction image. According to an embodiment, $\beta$ may be determined within the range of 0 to 5.

The display device 100 according to an embodiment of the disclosure may acquire a light amount of an input image by summing up the brightness of each of a plurality of pixels included in the input image, and acquire a target light amount which is a reduced amount of the light amount of the input image by a predetermined ratio. As an example, the display device 100 may acquire a target light amount which is 50% of the light amount of the input image. The display device 100 may calculate a first light amount difference between the light amount of the first correction image which is a result of summing up the brightness of each of the plurality of pixels included in the first correction image and the target light amount. Here, the first light amount difference means $\omega_{LUMA}$ in the formula 2.

The display device 100 according to an embodiment of the disclosure may calculate a difference in a first perceived visual sense between the first correction image and an input image. For example, if the first and second adjustment values are $\alpha$=255, $\beta$=−1.2, respectively in the formula 3, the display device 100 may acquire a graph maintaining the gradation for each pixel included in an input image. In this case, the display device 100 may calculate a difference in the first perceived visual sense on the basis of a difference value between the graph indicating the gradation for each pixel included in the input image and the first gradation adjustment curve corresponding to the first correction image (the first and second adjustment values are $\alpha$=255, $\beta$=2, respectively). Here, the difference value may mean an area between the two graphs. The difference in the first perceived visual sense means $\omega_{SIM}$ in the formula 2. The display device 100 may acquire a first correction effect by applying different weighted values ($\alpha_{SIM}$, $\alpha_{LUMA}$, and $\alpha_{GRARE}$) to each of the difference in the first perceived visual sense ($\omega_{SIM}$), the first light amount difference ($\omega_{LUMA}$), and the first brightness difference ($\omega_{GRARE}$).

The display device 100 may calculate a second light amount difference between the light amount of a second correction image which is a result of summing the brightness of each of a plurality of pixels included in the second correction image and the target light amount. Also, the display device 100 may calculate a second brightness difference, and a difference in a second perceived visual sense. Then, the display device 100 may acquire a second correction effect by applying different weighted values ($\alpha_{SIM}$, $\alpha_{LUMA}$, and $\alpha_{GRARE}$) to each of the difference in the second perceived visual sense ($\omega_{SIM}$), the second light amount difference ($\omega_{LUMA}$), and the second brightness difference ($\omega_{GRARE}$).

According to an embodiment, the display device 100 may acquire a gradation adjustment curve corresponding to the maximum correction effect between the first and second correction effects. As an example, the display device 100 may identify the correction effect having the smaller value between the first and second correction effects acquired on the basis of the formula 2 as the maximum correction effect, and acquire a gradation adjustment curve corresponding to the identified maximum correction effect.

Meanwhile, the formula 3 is merely an embodiment of a gradation adjustment curve, and the disclosure is not necessarily limited thereto. The display device 100 may acquire a gradation adjustment value corresponding to a gradation value of an input image on the basis of known tone mapping (TM) curves in various forms.

Figure 6:
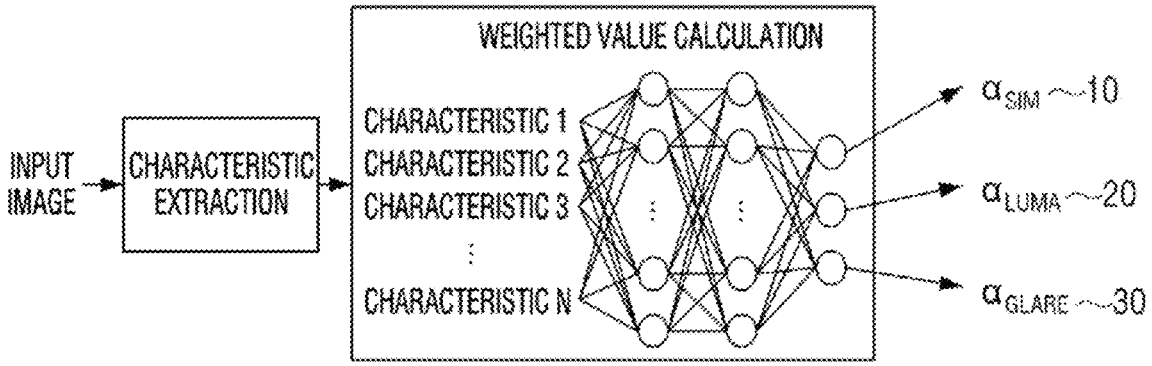
FIG. 6 is a diagram for illustrating a weighted value according to an embodiment of the disclosure.

FIG. 6 is a diagram for illustrating a weighted value according to an embodiment of the disclosure.

Referring to FIG. 6, the display device 100 according to an embodiment of the disclosure may calculate weighted values by performing machine learning to a plurality of sample images. For example, the display device 100 may acquire an image processing model by performing convolution neural network (CNN) training to a plurality of sample images having different characteristics from one another. Here, a CNN is a multilayer neural network having a special connection structure designed for voice processing, image processing, etc.

According to an embodiment, the display device 100 may acquire weighted values from an image processing model on the basis of the characteristics of an input image. Here, the characteristics of an input image may include the contrast, the contrast ratio, the power consumption required for outputting the image, the gamma value, etc. of the image.

The display device 100 may identify an image including characteristics similar to the characteristics of the input image among the plurality of sample images, and acquire information on weighted values according to the maximum correction effect of the identified image. Then, the display device 100 may acquire a first weighted value ($\alpha_{SIM}$) 10, a second weighted value ($\alpha_{LUMA}$) 20, and a third weighted value ($\alpha_{GRARE}$) 30 on the basis of the information on the weighted values. The display device 100 may acquire a correction effect on the basis of the acquired first to third weighted values 10, 20, 30, and the formula 2.

As another example, the display device 100 can obviously acquire information on weighted values from a server, and acquire a first weighted value ($\alpha_{SIM}$) 10, a second weighted value ($\alpha_{LUMA}$) 20, and a third weighted value ($\alpha_{GRARE}$) 30 on the basis of the information on the weighted values.

As still another example, the display device 100 can obviously acquire the first to third weighted values 10, 20, 30 on the basis of a value set by the manufacturer in the manufacturing step, a value set according to a user input, etc.

Meanwhile, the display device 100 according to an embodiment of the disclosure may acquire a correction effect on the basis of the formula 4.

$$E=\alpha_{SIM}\omega_{SIM}+\alpha_{LUMA}\omega_{LUMA}+\alpha_{GRARE}\omega_{GRARE}+\alpha_A\omega_A+\ldots \quad \text{[Formula 4]}$$

Here, $\alpha_{SIM}$ is the first weighted value 10, $\alpha_{LUMA}$ is the second weighted value 20, $\alpha_{GRARE}$ is the third weighted value 30, $\alpha_A$ is the fourth weighted value, $\omega_{SIM}$ is the difference in the first perceived visual sense, $\omega_{LUMA}$ is the first light amount difference, $\omega_{GRARE}$ is the first brightness difference, and $\omega_A$ is the amount of change of the characteristics of a correction image compared to the input image.

Here, $\omega_A$ is the amount of change of the characteristics of a correction image compared to the input image, that is, a correction effect may be acquired by setting all changed characteristics of a correction image compared to the input image as a gradation is changed by applying a gradation adjustment curve of the display device 100 to the input image as $\omega_A$. The characteristics of the image may include the contrast, the contrast ratio, the power consumption required for outputting the image, the gamma value, etc. of the image.

The display device 100 according to an embodiment of the disclosure may acquire a correction effect E on the basis of at least one of the formula 2 or the formula 4.

Figure 7:
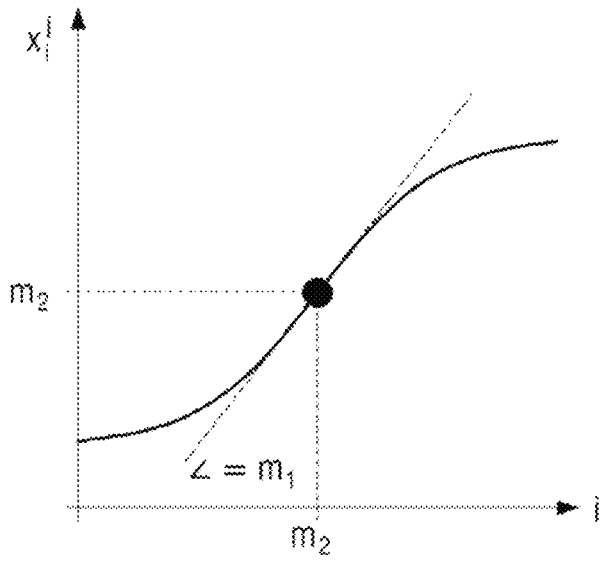
FIG. 7 is a graph for illustrating a local gradation adjustment curve according to an embodiment of the disclosure.

FIG. 7 is a graph for illustrating a local gradation adjustment curve according to an embodiment of the disclosure.

When a gradation for each pixel of an input image is adjusted on the basis of a gradation adjustment curve, the display device 100 may identify the adjusted input image as a plurality of blocks. As an example, the display device 100 may divide a correction image which is a result of applying a gradation adjustment curve to an input image into a plurality of blocks. The display device 100 may acquire a local gradation adjustment curve corresponding to a block on the basis of the gradation distribution and gradation average values inside the block.

For example, the display device 100 may acquire $m_1(=\sigma_{in}/\sigma_t)$ on the basis of a ratio between the distribution $\sigma_{in}$ of gradations included in an area corresponding to the first block of the correction image and the distribution $\sigma_{in}$ of gradations included in the first block of the correction image to which a gradation adjustment curve was applied in the input image. Also, the display device 100 may acquire $m_2$ on the basis of the average value of gradations that were reduced compared to the input image as a gradation adjustment curve was applied among the gradations included in the first block.

The display device 100 according to an embodiment may acquire a local gradation adjustment curve on the basis of the following formula 5.

$$x_i^j = \frac{20}{1+e^{-m_1(i-m_2)}} + m_2 - 10 \quad \text{[Formula 5]}$$

Here, i means a gradation for each pixel included in a block, and $x_i^j$ means a gradation adjusted according to applying a local gradation adjustment curve to the gradation i inside the jth block.

The display device 100 may acquire a correction image by applying a gradation adjustment curve (e.g., a gradation adjustment curve on the basis of the formula 3) to an input image. Then, the display device 100 may divide the correction image into a plurality of blocks, and acquire a plurality of local gradation adjustment curves corresponding to each of the plurality of blocks. The display device 100 may adjust a gradation for each pixel included in a block by applying a local gradation adjustment curve to the block. Accordingly, the light amount of the block may be maintained, and at the same time, the dynamic range may be increased.

The display device 100 according to an embodiment of the disclosure may output a block to which a local gradation adjustment curve is applied. For example, the display device 100 may apply a first local gradation adjustment curve to the first block, and output the first block of which gradation was adjusted.

As another example, the display device 100 may apply different weighted values to each of the first block in a correction image to which a gradation adjustment curve is applied and the first block of which gradation was adjusted by applying a local gradation adjustment curve to the first block, and output the blocks. For example, the display device 100 may apply the first weighted value to each of the gradation values of the pixels included in the first block of an image to which a gradation adjustment curve was applied, apply the second weighted value to each of the gradation values of the pixels included in a block corresponding to the first block of an image to which a local gradation adjustment curve was applied, and adjust and output the gradation for each pixel on the basis of the gradation value to which the first weighted value was applied and the gradation value to which the second weighted value was applied.

$$\tilde{t}_i^j = \omega_i \cdot x_i^j + (1-\omega_i)\cdot t_i \quad \text{[Formula 6]}$$

Here, $x_i^j$ means a gradation adjusted according to applying a local gradation adjustment curve to the gradation i inside the jth block, $t_i$ means a gradation adjusted according to applying a gradation adjustment curve to the gradation i in an input image, and $\omega_i$ means a weighted value.

The display device 100 according to an embodiment of the disclosure may set $\omega_i$ to be close to 1 as the gradation i gets relatively close to $m_2$, and set $\omega_i$ to be close to 0 as the gradation i gets relatively far from $m_2$.

The display device 100 according to an embodiment of the disclosure may acquire the code value of each of R, G, and B on the basis of $$\hat{\tau}_i^j.$$

$$\hat{R}_p^j = \hat{\tau}_{R_p^j}^j \quad \text{[Formula 7]}$$

$$\hat{G}_p^j = \hat{\tau}_{G_p^j}^j \quad \text{[Formula 8]}$$

$$\hat{B}_p^j = \hat{\tau}_{B_p^j}^j \quad \text{[Formula 9]}$$

Here, $$\hat{R}_p^j, \hat{G}_p^j, \hat{B}_p^j,$$

and $R_P^j$, $G_P^j$, $B_P^j$ respectively mean the R, G, and B code values in a pixel P in the jth block inside a correction image and an input image.

The display device 100 according to an embodiment of the disclosure may acquire a correction image on the basis of $$\hat{R}_p^j, \hat{G}_p^j, \hat{B}_p^j,$$

and output the acquired correction image.

FIG. 8 is a table for illustrating current gains according to an embodiment of the disclosure.

The display device 100 according to an embodiment of the disclosure may store information on the current gain for each maximum brightness of an image.

When a gradation for each pixel of an input image is adjusted on the basis of a gradation adjustment curve, the display device 100 may acquire current gain information corresponding to the maximum output brightness of the adjusted input image. As an example, if the maximum output brightness of a correction image acquired by applying a gradation adjustment curve to an input image is 900 Nits, the display device 100 may acquire current gain information corresponding to 900 Nits. Referring to FIG. 8, the current gains corresponding to each of R, G, and B are 240 mA, 300 mA, and 180 mA.

As another example, the display device 100 may divide a correction image acquired by applying a gradation adjustment curve to an input image into a plurality of blocks, and apply a local gradation adjustment curve to each of the plurality of blocks. Specifically, the display device 100 may acquire an output image by weight summing an image to which a gradation adjustment curve was applied and an image to which a local gradation adjustment curve was applied on the basis of the formula 6. Then, the display device 100 may acquire current gain information corresponding to the maximum output brightness of the output image. For example, if the maximum output brightness of the output image is 100 Nits, the current gains corresponding to each of R, G, and B may be 40 mA, 50 mA, and 30 mA. The display device 100 may control currents provided to the display 130 on the basis of the acquired current gains.

Figure 9:
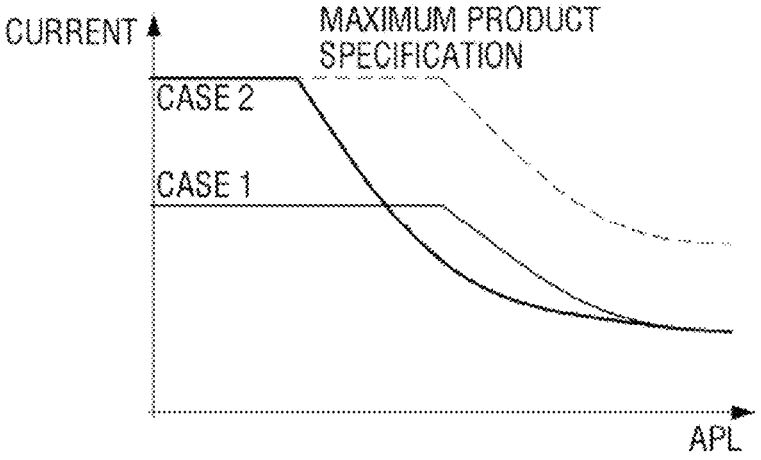
FIG. 9 is a graph for illustrating a display device adjusting a light amount according to the conventional technology.

FIG. 9 is a graph for illustrating a display device adjusting a light amount according to the conventional technology.

Referring to FIG. 9, methods for adjusting a light amount according to the conventional technology may be divided into a Case 1 and a Case 2.

According to the Case 1, the display device 100 may reduce currents provided to the display 130 by a specific ratio (e.g., 50%) compared to the maximum providable currents of the display device 100 for preventing a glare phenomenon. As the light amount of an image output through the display 130 is in proportion to the currents provided to the display 130, the light amount of the output image may be reduced by a specific ratio, and a glare phenomenon may not occur. However, there is a problem that the dynamic range of the output image compared to the input image is reduced and distortion and degradation of the image occur.

According to the Case 2, if brightness of an input image is greater than or equal to a specific level, the display device 100 may reduce the currents provided to the display 130. In this case, the display device 100 may reduce a light amount by a specific ratio only for a relatively bright input image, and output the image. In a relatively dark input image, the dynamic range may be maintained, and distortion and degradation may not occur. However, in a bright image, there is a problem that distortion and degradation occur in a similar manner to the Case 1.

The display device 100 according to an embodiment of the disclosure adjusts a gradation for each pixel of an input image on the basis of the maximum correction effect among a plurality of correction effects based on a difference in a perceived visual sense between a plurality of correction images and the input image, a difference between the brightness of each of the plurality of correction images and the target brightness, and a difference between the light amount of each of the plurality of correction images and the target light amount. Accordingly, occurrence of distortion and degradation can be minimized, and at the same time, a glare phenomenon can be prevented by reducing a light amount of an image by a specific ratio.

Figure 10:
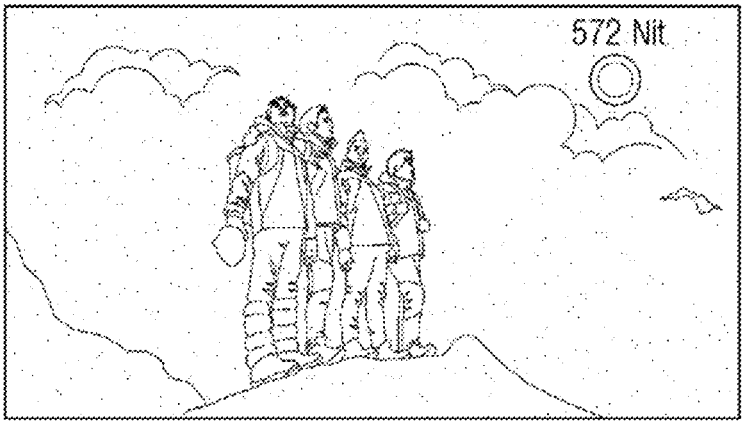
FIG. 10 is a diagram for illustrating adjustment of a light amount and brightness according to an embodiment of the disclosure.
Figure 10:
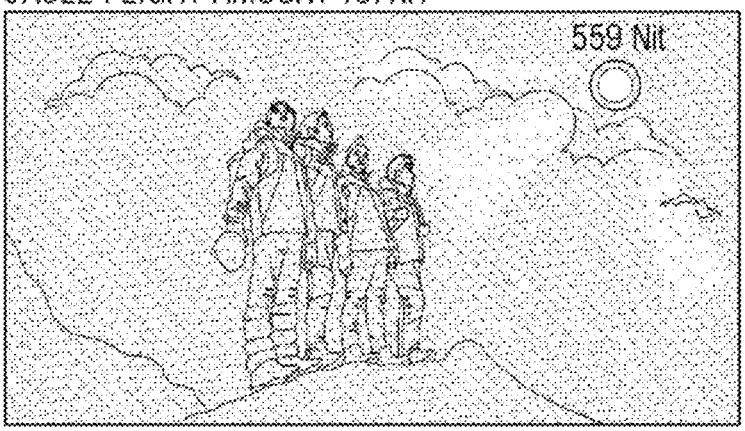
Figure 10:
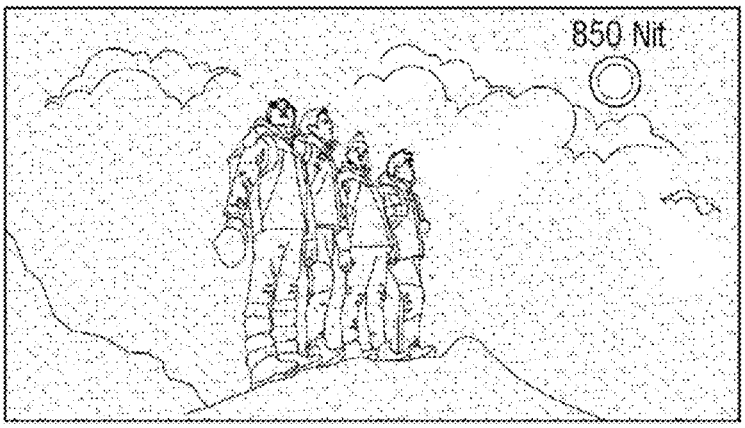

FIG. 10 is a diagram for illustrating adjustment of a light amount and brightness according to an embodiment of the disclosure.

Referring to FIG. 10, the Case 1 to the Case 3 are based on the assumption of a case wherein the same input image is output with the same light amount. In the Case 1 and the Case 2, the light amount of the input image was reduced by using the method described in FIG. 9. In the Case 3, the light amount of the input image was reduced based on various embodiments of the disclosure.

In the Case 1, the maximum output brightness is 572 Nits, and in the Case 2, the maximum output brightness is 559 Nits. Also, the dynamic range was reduced compared to the input image, and degradation and distortion of the image occurred. In the Case 3, the maximum output brightness is 850 Nits. Also, an image may be output with the same light amount as in the Case 1 and the Case 2, and at the same time, the maximum output brightness may be increased. That is, the width of the dynamic range may be maintained or increased, and occurrence of degradation and distortion of the image may be minimized.

Figure 11:
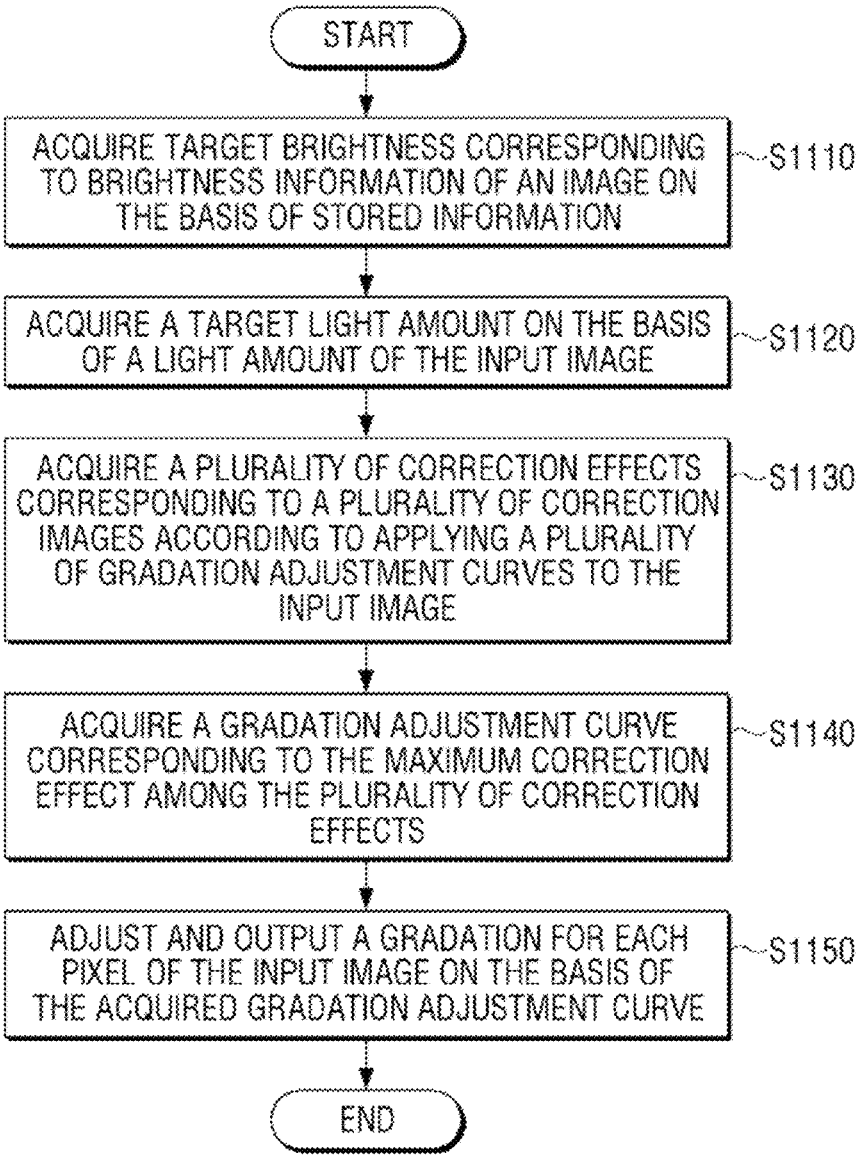
FIG. 11 is a flow chart for illustrating a method for controlling brightness of a display device according to an embodiment of the disclosure.

FIG. 11 is a flow chart for illustrating a method for controlling brightness of a display device according to an embodiment of the disclosure.

According to FIG. 11, in a method for controlling brightness of a display device storing output brightness information for each gradation according to brightness information of an image according to an embodiment of the disclosure, target brightness corresponding to brightness information of an input image is acquired on the basis of the stored information at operation S1110.

Then, a target light amount is acquired on the basis of a light amount of the input image at operation S1120.

Then, a plurality of correction effects corresponding to a plurality of correction images are acquired according to applying a plurality of gradation adjustment curves to the input image at operation S1130.

Then, a gradation adjustment curve corresponding to the maximum correction effect among the plurality of correction effects is acquired at operation S1140.

Then, a gradation for each pixel of the input image is adjusted and output on the basis of the acquired gradation adjustment curve at operation S1150.

Here, the plurality of correction effects are acquired on the basis of a difference in a perceived visual sense between each of the plurality of correction images and the input image, a difference between the brightness of each of the plurality of correction images and the target brightness, and a difference between the light amount of each of the plurality of correction images and the target light amount.

Here, the target brightness may be the maximum output brightness corresponding to the brightness information of the input image, and the brightness of each of the plurality of correction images may be the maximum output brightness corresponding to the brightness information of each of the plurality of correction images.

Meanwhile, at the operation S1120 of acquiring a target light amount, the light amount of the input image may be acquired by summing up the brightness of each of the plurality of pixels included in the input image, and the target light amount may be a light amount which is a reduced amount of the light amount of the input image by a predetermined ratio.

Also, the operation S1130 of acquiring a plurality of correction effects may include the steps of acquiring a first correction image by applying a first gradation adjustment curve among the plurality of gradation adjustment curves to the input image, calculating a difference in a first perceived visual sense on the basis of a difference value between a graph indicating the gradation for each pixel included in the input image and the first gradation adjustment curve, calculating a first light amount difference between the light amount of the first correction image and the target light amount, calculating a first brightness difference between the maximum output brightness of the first correction image and the target brightness, and acquiring a first correction effect on the basis of the following formula.

$$E=\alpha_{SIM}\omega_{SIM}+\alpha_{LUMA}\omega_{LUMA}+\alpha_{GRARE}\omega_{GRARE}$$

Here, $\alpha_{SIM}$ may be a first weighted value, $\alpha_{LUMA}$ may be a second weighted value, $\alpha_{GRARE}$ may be a third weighted value, $\omega_{SIM}$ may be the difference in the first perceived visual sense, $\omega_{LUMA}$ may be the first light amount difference, and $\omega_{GRARE}$ may be the first brightness difference, and each of the $\alpha_{SIM}$, the $\alpha_{LUMA}$, and the $\alpha_{GRARE}$ may be a weighted value that is neural network trained on the basis of a plurality of sample images.

Also, the operation S1130 of acquiring a plurality of correction effects may include the steps of acquiring a second correction image by applying a second gradation adjustment curve among the plurality of gradation adjustment curves to the input image, calculating a difference in a second perceived visual sense on the basis of the second gradation adjustment curve, and calculating a second light amount difference and a second brightness difference on the basis of the second correction image, and acquiring a second correction effect on the basis of the difference in the second perceived visual sense, the second light amount difference, and the second brightness difference. In addition, at the operation S1150 of adjusting and outputting the gradation for each pixel of the input image, the gradation for each pixel of the input image may be adjusted and output on the basis of a gradation adjustment curve corresponding to the smaller value between the first correction effect and the second correction effect.

Further, the plurality of gradation adjustment curves may be a graph indicated by the following formula, and have different αs and βs.

$$t_i = \alpha \times \frac{i}{255}^{(2.2+\beta)}$$

Here, i means the gradation for each pixel included in an input image, α and β respectively mean first and second adjustment values, and $t_i$ means the gradation of a correction image.

Meanwhile, a display device according to an embodiment of the disclosure may include information for a current gain for each maximum brightness of an image, and a method for controlling brightness according to an embodiment may include the steps of, based on the gradation for each pixel of the input image being adjusted on the basis of the acquired gradation adjustment curve, acquiring current gain information corresponding to the maximum output brightness of the adjusted input image from the information, and controlling currents provided to the display included in the display device on the basis of the current gain information.

Also, brightness information of the image may be an average picture level (APL) of the image, and output brightness information for each gradation according to the brightness information of the image may be the maximum output brightness information for each gradation according to the average picture level calculated on the basis of the power consumption of the display device.

In addition, the method for controlling brightness according to an embodiment may include the steps of, based on the gradation for each pixel of the input image being adjusted on the basis of the acquired gradation adjustment curve, identifying the adjusted input image as a plurality of blocks, and acquiring a local gradation adjustment curve corresponding to each of the plurality of blocks on the basis of gradation distribution and gradation average values of each of the plurality of blocks, and adjusting the gradation for each pixel of each of the plurality of blocks on the basis of the acquired local gradation adjustment curve.

Here, the controlling method may include the steps of, applying the first weighted value to each gradation value of pixels included in a first block of an image to which the gradation adjustment curve was applied, applying the second weighted value to each gradation value of pixels included in a block corresponding to the first block in an image to which the local gradation adjustment curve was applied, and adjusting and outputting the gradation for each pixel on the basis of the gradation value to which the first weighted value was applied and the gradation value to which the second weighted value was applied.

Meanwhile, the methods according to the various embodiments of the disclosure described above may be implemented in forms of applications that can be installed on conventional electronic devices.

Also, the methods according to the various embodiments of the disclosure described above may be implemented just by software upgrade, or hardware upgrade of conventional electronic devices.

In addition, the various embodiments of the disclosure described above may be performed through an embedded server provided on an electronic device, or an external server of an electronic device.

Meanwhile, the various embodiments described above may be implemented in a recording medium that can be read by a computer or a device similar to a computer by using software, hardware or a combination thereof. In some cases, the embodiments described in this specification may be implemented as the processor itself. Meanwhile, according to implementation by software, the embodiments such as procedures and functions described in this specification may be implemented as separate software modules. Each of the software modules may perform one or more functions and operations described in this specification.

Meanwhile, computer instructions for performing processing operations according to the various embodiments of the disclosure described above may be stored in a non-transitory computer-readable medium. Computer instructions stored in such a non-transitory computer-readable medium make the processing operations according to the various embodiments described above performed by a specific machine, when the instructions are executed by the processor of the specific machine.

A non-transitory computer-readable medium refers to a medium that stores data semi-permanently, and is readable by machines, but not a medium that stores data for a short moment such as a register, a cache, and a memory. As specific examples of a non-transitory computer-readable medium, there may be a CD, a DVD, a hard disc, a blue-ray disc, a USB, a memory card, a ROM and the like.

Also, while preferred embodiments of the disclosure have been shown and described, the disclosure is not limited to the aforementioned specific embodiments, and it is apparent that various modifications can be made by those having ordinary skill in the art to which the disclosure belongs, without departing from the gist of the disclosure as claimed by the appended claims. Further, it is intended that such modifications are not to be interpreted independently from the technical idea or prospect of the disclosure.

What is claimed is:

1. A display device comprising:

a storage configured to store output brightness information for each gradation according to brightness information of an image; and a processor configured to:

acquire target brightness corresponding to brightness information of an input image on the basis of the information stored in the storage, acquire a target light amount on the basis of a light amount of the input image, acquire a plurality of correction effects corresponding to a plurality of correction images by applying a plurality of gradation adjustment curves to the input image, acquire a gradation adjustment curve corresponding to the maximum correction effect among the plurality of correction effects, and adjust and output a gradation for each pixel of the input image on the basis of the acquired gradation adjustment curve, wherein the plurality of correction effects are acquired on the basis of a difference in a perceived visual sense between each of the plurality of correction images and the input image, a difference between the brightness of each of the plurality of correction images and the target brightness, and a difference between the light amount of each of the plurality of correction images and the target light amount.

2. The display device of claim 1, wherein the target brightness is the maximum output brightness corresponding to the brightness information of the input image, and the brightness of each of the plurality of correction images is the maximum output brightness corresponding to the brightness information of each of the plurality of correction images.

3. The display device of claim 1, wherein the processor is configured to:

acquire the light amount of the input image by summing up the brightness of each of the plurality of pixels included in the input image, and the target light amount is a light amount which is a reduced amount of the light amount of the input image by a predetermined ratio.

4. The display device of claim 1, wherein the processor is configured to:

acquire a first correction image by applying a first gradation adjustment curve among the plurality of gradation adjustment curves to the input image, calculate a difference in a first perceived visual sense on the basis of a difference value between a graph indicating the gradation for each pixel included in the input image and the first gradation adjustment curve, calculate a first light amount difference between the light amount of the first correction image and the target light amount, calculate a first brightness difference between the maximum output brightness of the first correction image and the target brightness, and acquire a first correction effect on the basis of the following formula:

$$E=\alpha_{SIM}\omega_{SIM}+\alpha_{LUMA}\omega_{LUMA}+\alpha_{GRARE}\omega_{GRARE},$$

wherein $\alpha_{SIM}$ is a first weighted value, $\alpha_{LUMA}$ is a second weighted value, $\alpha_{GRARE}$ is a third weighted value, $\omega_{SIM}$ is the difference in the first perceived visual sense, $\omega_{LUMA}$ is the first light amount difference, and $\omega_{GRARE}$ is the first brightness difference, and each of the $\alpha_{SIM}$, the $\alpha_{LUMA}$, and the $\alpha_{GRARE}$ is a weighted value that is neural network trained on the basis of a plurality of sample images.

5. The display device of claim 4, wherein the processor is configured to:

acquire a second correction image by applying a second gradation adjustment curve among the plurality of gradation adjustment curves to the input image, calculate a difference in a second perceived visual sense on the basis of the second gradation adjustment curve, and calculate a second light amount difference and a second brightness difference on the basis of the second correction image, acquire a second correction effect on the basis of the difference in the second perceived visual sense, the second light amount difference, and the second brightness difference, and adjust and output the gradation for each pixel of the input image on the basis of a gradation adjustment curve corresponding to the smaller value between the first correction effect and the second correction effect.

6. The display device of claim 1, wherein the plurality of gradation adjustment curves is a graph indicated by the following formula, and have different αs and βs:

$$t_i = \alpha \times \frac{i}{255}^{(2.2+\beta)},$$

wherein i means the gradation for each pixel included in an input image, α and β respectively mean first and second adjustment values, and $t_i$ means the gradation of a correction image.

7. The display device of claim 1, further comprising:

a display, wherein the storage stores information for a current gain for each maximum brightness of an image, and the processor is configured to:

based on the gradation for each pixel of the input image being adjusted on the basis of the acquired gradation adjustment curve, acquire current gain information corresponding to the maximum output brightness of the adjusted input image from the storage, and control currents provided to the display on the basis of the current gain information.

8. The display device of claim 1, wherein brightness information of the image is an average picture level (APL) of the image, and output brightness information for each gradation according to the brightness information of the image is the maximum output brightness information for each gradation according to the average picture level calculated on the basis of the power consumption of the display device.

9. The display device of claim 1, wherein the processor is configured to:

based on the gradation for each pixel of the input image being adjusted on the basis of the acquired gradation adjustment curve, identify the adjusted input image as a plurality of blocks, and acquire a local gradation adjustment curve corresponding to each of the plurality of blocks on the basis of gradation distribution and gradation average values of each of the plurality of blocks, and adjust the gradation for each pixel of each of the plurality of blocks on the basis of the acquired local gradation adjustment curve.

10. The display device of claim 9, wherein the processor is configured to:

apply the first weighted value to each gradation value of pixels included in a first block of an image to which the gradation adjustment curve was applied, apply the second weighted value to each gradation value of pixels included in a block corresponding to the first block in an image to which the local gradation adjustment curve was applied, and adjust and output the gradation for each pixel on the basis of the gradation value to which the first weighted value was applied and the gradation value to which the second weighted value was applied.

11. A method for controlling brightness of a display device storing output brightness information for each gradation according to brightness information of an image, the method comprising:

acquiring target brightness corresponding to brightness information of an input image on the basis of the stored information;

acquiring a target light amount on the basis of a light amount of the input image;

acquiring a plurality of correction effects corresponding to a plurality of correction images by applying a plurality of gradation adjustment curves to the input image;

acquiring a gradation adjustment curve corresponding to the maximum correction effect among the plurality of correction effects; and adjusting and outputting a gradation for each pixel of the input image on the basis of the acquired gradation adjustment curve, wherein the plurality of correction effects are acquired on the basis of a difference in a perceived visual sense between each of the plurality of correction images and the input image, a difference between the brightness of each of the plurality of correction images and the target brightness, and a difference between the light amount of each of the plurality of correction images and the target light amount.

12. The controlling method of claim 11, wherein the target brightness is the maximum output brightness corresponding to the brightness information of the input image, and the brightness of each of the plurality of correction images is the maximum output brightness corresponding to the brightness information of each of the plurality of correction images.

13. The controlling method of claim 11, wherein the acquiring a target light amount comprises:

acquiring the light amount of the input image by summing up the brightness of each of the plurality of pixels included in the input image, and the target light amount is a light amount which is a reduced amount of the light amount of the input image by a predetermined ratio.

14. The controlling method of claim 11, wherein the acquiring a plurality of correction effects comprises:

acquiring a first correction image by applying a first gradation adjustment curve among the plurality of gradation adjustment curves to the input image;

calculating a difference in a first perceived visual sense on the basis of a difference value between a graph indicating the gradation for each pixel included in the input image and the first gradation adjustment curve;

calculating a first light amount difference between the light amount of the first correction image and the target light amount;

calculating a first brightness difference between the maximum output brightness of the first correction image and the target brightness; and acquiring a first correction effect on the basis of the following formula:

$$E=\alpha_{SIM}\omega_{SIM}+\alpha_{LUMA}\omega_{LUMA}+\alpha_{GRARE}\omega_{GRARE},$$

wherein $\alpha_{SIM}$ is a first weighted value, $\alpha_{LUMA}$ is a second weighted value, $\alpha_{GRARE}$ is a third weighted value, $\omega_{SIM}$ is the difference in the first perceived visual sense, $\omega_{LUMA}$ is the first light amount difference, and $\omega_{GRARE}$ is the first brightness difference, and each of the $\alpha_{SIM}$, the $\alpha_{LUMA}$, and the $\alpha_{GRARE}$ is a weighted value that is neural network trained on the basis of a plurality of sample images.

15. The controlling method of claim 14, wherein the acquiring a plurality of correction effects comprises:

acquiring a second correction image by applying a second gradation adjustment curve among the plurality of gradation adjustment curves to the input image;

calculating a difference in a second perceived visual sense on the basis of the second gradation adjustment curve, and calculating a second light amount difference and a second brightness difference on the basis of the second correction image; and acquiring a second correction effect on the basis of the difference in the second perceived visual sense, the second light amount difference, and the second brightness difference, wherein the adjusting and outputting the gradation for each pixel of the input image comprises:

adjusting and outputting the gradation for each pixel of the input image on the basis of a gradation adjustment curve corresponding to the smaller value between the first correction effect and the second correction effect.

* * * * *